US006300029B1

(12) United States Patent
Rokutanzono

(10) Patent No.: US 6,300,029 B1
(45) Date of Patent: Oct. 9, 2001

(54) ELECTROPHOTOGRAPHIC IMAGE FORMING PROCESS AND ELECTROPHOTOGRAPHIC PHOTOCONDUCTOR

(75) Inventor: Takashi Rokutanzono, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/516,722

(22) Filed: Mar. 1, 2000

(30) Foreign Application Priority Data

Mar. 2, 1999 (JP) ..... 11-053548
Mar. 2, 1999 (JP) ..... 11-053549
Mar. 2, 1999 (JP) ..... 11-053550

(51) Int. Cl.[7] ..... G03G 13/06
(52) U.S. Cl. ..... 430/100; 430/83
(58) Field of Search ..... 430/100, 126, 430/130, 66, 83

(56) References Cited

U.S. PATENT DOCUMENTS 3,637,433 * 1/1972 Sims ..... 430/130
5,102,757 * 4/1992 Akasaki et al. ..... 430/100
5,280,326 * 1/1994 Pinhas et al. ..... 430/100

* cited by examiner

*Primary Examiner*—John Goodrow
(74) *Attorney, Agent, or Firm*—Cooper & Dunham LLP

(57) ABSTRACT

An electrophotographic image forming process includes the steps of charging, light exposure, reversal development, and image transfer, using a photoconductor having an electro-conductive support, and a photo-conductive layer formed thereon, with a residual solvent being contained in the photoconductor, and the electrophotographic photoconductor showing a residual potential change ratio of 200% or less, a sensitivity change ratio of 30% or less, and an electrostatic capacity change ratio of 30% or less. The photoconductor for use with the above-mentioned image forming process is also disclosed.

60 Claims, 3 Drawing Sheets

ELECTROPHOTOGRAPHIC IMAGE FORMING PROCESS AND ELECTROPHOTOGRAPHIC PHOTOCONDUCTOR

BACKGROUND OF THE INVENTION

1. Field of the Invention

The present invention relates to an electrophotographic image forming process using an electrophotographic photoconductor, and more particularly to an electrophotographic image forming process comprising the steps of charging, light exposure, reversal development, and image transfer, using an electrophotographic photoconductor comprising an electroconductive support and a photoconductive layer formed thereon comprising a residual solvent.

2. Discussion of Background

The Carlson process and other processes obtained by modifying the Carlson process are conventionally known as the electrophotographic methods, and widely utilized in the copying machine and printer. In a photoconductor for use with the electrophotographic method, an organic photoconductive material is now widely used because such an organic photoconductor can be manufactured at low cost by mass production, and causes no environmental pollution.

Many kinds of organic photoconductors are conventionally proposed, for example, a photoconductor employing a photoconductive resin such as polyvinylcarbazole (PVK); a photoconductor comprising a charge transport complex of polyvinylcarbazole (PVK) and 2,4,7-trinitrofluorenone (TNF); a photoconductor of a pigment dispersed type in which a phthalocyanine pigment is dispersed in a binder resin; and a function-separating photoconductor comprising a charge generation material and a charge transport material. In particular, the function-separating photoconductor has now attracted considerable attention.

The mechanism of the formation of latent electrostatic images on the function-separating photoconductor is as follows:

When the photoconductor is charged to a predetermined polarity and exposed to light, the light passes through a transparent charge transport layer, and is absorbed by a charge generation material in a charge generation layer. The charge generation material generates charge carriers by the absorption of light. The charge carriers generated in the charge generation layer are injected into the charge transport layer, and move in the charge transport layer depending on the electric field applied to the photoconductor at the charging step. Thus, latent electrostatic images are formed on the surface of the photoconductor by neutralizing the charge thereon. As is known, it is effective that the function-separating electrophotographic photoconductor employ in combination a charge transport material having an absorption intensity mainly in the ultraviolet region, and a charge generation material having an absorption intensity mainly in the visible region.

As the charge transport materials, many low-molecular weight compounds have been developed. However, the film-forming properties of such a low-molecular weight compound are very poor, so that the low-molecular weight charge transport material is dispersed and mixed with an inert polymer to prepare a charge transport layer. The charge transport layer thus prepared using the low-molecular weight charge transport material and the inert polymer is generally so soft that the charge transport layer will easily peel off during the repeated electrophotographic operations by the Carlson process.

The electrophotographic process using the above-mentioned electrophotographic photoconductors has made remarkable progress in recent years. Namely, the conventional Carlson process has been improved from various aspects. For instance, improvement in the cleaning step to completely cancel the previous record of image forming operation is described in Japanese Laid-Open Patent Application 58-102273; improvement in the charging step to reduce the amount of generated ozone is described in Japanese Laid-Open Patent Applications 56-104351, 57-178267, 58-40566, 58-139156, 58-150975, and 63-149669; and improvement in the image transfer step to upgrade the image quality of the obtained image is described in Japanese Laid-Open Patent Applications 5-45916 and 7-152217.

However, in the electrophotographic process including the reversal development, the charge with a polarity opposite to the polarity obtained by the charging step is necessarily applied to the photoconductor in the image transfer step. As a result, charge carriers are easily trapped at the interface between the undercoat layer and the charge generation layer, between the charge generation layer and the charge transfer layer, or between the photoconductive layer and the protective layer, in the electrophotographic photoconductor. In particular, it is considerably difficult to remove the charge carrier with the opposite polarity once accumulated at the above-mentioned portions. In the electrophotographic process including the reversal development, the charge with the opposite polarity is applied to the photoconductor at the image transfer step, and the charge carriers are readily trapped in the portion of the photoconductor which is subjected to image transfer charging.

As a result, there are caused various problems. One of the problems is that the charging potential and the potential after light exposure are unfavorably decreased in the repeated electrophotographic operations, with the result that the obtained character images become thicker.

Further, the above-discussed trapped charge carriers tend to easily gather at the edge portion of an image transfer sheet. Therefore, there is a risk of a stripe image abnormally appearing on the image transfer sheet at the edge portion thereof, perpendicular to the transporting direction of the transfer sheet. To solve the above-mentioned problem, it is proposed that the photoconductor be charged to the opposite polarity with respect to the polarity of the image transfer charging after the completion of image transfer step in order to compulsorily cancel the charge carriers by means of the applied electric field.

In addition, there is proposed an electrophotographic image forming apparatus comprising a means for removing the trapped charge carriers by simultaneously carrying out the light exposure step and the charging step, which means is provided between the image transfer means and the charging means (Japanese Laid-Open Patent Application 8-262941). However, in the case where the energy level of the trapped carrier is deep, the above-mentioned proposal is not effective. Further, since the light exposure and the charging are simultaneously carried out to cancel the trapped carrier, the photoconductor suffers electrostatic fatigue, with the result that the durability of the photoconductor is impaired.

Furthermore, because of the above-discussed trapped charge carriers, there occurs a troublesome problem. The problem is that the charging potential obtained in the first rotation of the photoconductor is different from the charging potential obtained after the photoconductor is rotated several times. In other words, the charging potential is not stabilized until the rotation of the photoconductor is repeated a plurality of times. In particular, a slight change in charging potential seriously affects the image quality in the electrophotographic color image forming process. To be more specific, formation of a color image is completed through a plurality of rotations of the photoconductor. If there is a change in charging potential, color reproduction cannot be exactly performed. In addition, when a plurality of copies is made, the image density becomes uneven.

This phenomenon is considered to depend upon the number of sheets which has been subjected to copying operation, and the time when the photoconductor is allowed to stand before the image formation is started again. The shorter the intermission, the more serious the phenomenon. The time required to stabilize the charging potential varies depending upon the amount of trapped carries and the time spent to release the trapped carriers.

As countermeasures against the above-mentioned phenomenon, it is proposed that the image forming process by the first rotation of the photoconductor be ignored, and the image forming processes by the second rotation and sequential rotations thereto be adopted in practice because the charging potential becomes stable after the second rotation. However, this is an obstacle to high-speed operation of the digital copier. In addition, the above-mentioned proposal cannot perfectly solve the problem in light of the factor of the intermission time before the image formation is started again.

Thus, there is proposed a photoconductor comprising a photoconductive layer which comprises a phthalocyanine compound, and an undercoat layer which is provided under the photoconductive layer and comprises a semiconductor material with a band gap of 2.2 eV or more and a binder resin (Japanese Laid-Open Patent Application 10-186703). The effect of this proposal is still unsatisfactory.

SUMMARY OF THE INVENTION

Accordingly, it is a first object of the present invention to provide an electrophotographic image forming process comprising the charging step, the light exposure step, the reversal development step, and the image transfer step wherein charging with a polarity opposite to that employed in the charging step is applied to the photoconductor, using an electrophotographic photoconductor comprising a photoconductive layer which contains a residual solvent component, capable of exhibiting high durability, and maintaining a stable potential after light exposure in the repeated operations so as to prevent the obtained character images from becoming thicker.

A second object of the present invention is to provide an electrophotographic image forming process comprising the charging step, the light exposure step, the reversal development step, and the image transfer step wherein charging with a polarity opposite to that employed in the charging step is applied to the photoconductor, using an electrophotographic photoconductor comprising a photoconductive layer which contains a residual solvent component, capable of exhibiting high durability, and preventing an abnormal stripe image from being produced on the image transfer sheet.

A third object of the present invention is to provide an electrophotographic image forming process comprising the charging step, the light exposure step, the reversal development step, and the image transfer step wherein charging with a polarity opposite to that employed in the charging step is applied to the photoconductor, using an electrophotographic photoconductor comprising a photoconductive layer which contains a residual solvent component, capable of exhibiting high durability, and producing a high quality image, in particular, high quality color image with excellent color reproduction and uniform image density.

A fourth object of the present invention is to provide an electrophotographic image forming process comprising the aforementioned steps, using an electrophotographic photoconductor comprising a photoconductive layer which contains a residual solvent component, capable of exhibiting high durability, maintaining a stable potential after light exposure in the repeated operations so as to prevent the obtained character images from becoming thicker, preventing an abnormal stripe image from being produced on the image transfer sheet, and producing a high quality image, in particular, high quality color image with excellent color reproduction and uniform image density.

A fifth object of the present invention is to provide an electrophotographic photoconductor for use with the above-mentioned image forming process, capable of exhibiting high durability, and maintaining a stable potential after light exposure in the repeated operations so as to prevent the obtained character images from becoming thicker.

A sixth object of the present invention is to provide an electrophotographic photoconductor for use with the above-mentioned image forming process, capable of exhibiting high durability, and preventing an abnormal stripe image from being produced on the image transfer sheet at the edge portion thereof.

A seventh object of the present invention is to provide an electrophotographic photoconductor for use with the above-mentioned image forming process, capable of exhibiting high durability, and producing a high quality image, in particular, high quality color image with excellent color reproducing and uniform image density.

An eighth object of the present invention is to provide an electrophotographic photoconductor for use with the above-mentioned image forming process, capable of exhibiting high durability, maintaining a stable potential after light exposure in the repeated operations so as to prevent the obtained character images from becoming thicker, preventing an abnormal stripe image from being produced on the image transfer sheet, and producing a high quality image, in particular, high quality color image with excellent color reproduction and uniform image density.

The above-mentioned first object of the present invention can be achieved by an electrophotographic image forming process using an electrophotographic photoconductor, comprising the steps of charging, light exposure, reversal development, and image transfer, the electrophotographic photoconductor comprising an electroconductive support, and a photoconductive layer formed thereon comprising a residual solvent component, and the electrophotographic photoconductor showing a residual potential change ratio of 200% or less.

The second object of the present invention can be achieved by an electrophotographic image forming process using an electrophotographic photoconductor, comprising the steps of charging, light exposure, reversal development, and image transfer, the electrophotographic photoconductor comprising an electroconductive support, and a photoconductive layer formed thereon comprising a residual solvent component, and the electrophotographic photoconductor showing a sensitivity change ratio of 30% or less.

The third object of the present invention can be achieved by an electrophotographic image forming process using an electrophotographic photoconductor, comprising the steps of charging, light exposure, reversal development, and image transfer, the electrophotographic photoconductor comprising an electroconductive support, and a photoconductive layer formed thereon comprising a residual solvent component, and the electrophotographic photoconductor showing an electrostatic capacity change ratio of 30% or less.

The fourth object of the present invention can be achieved by an electrophotographic image forming process using an electrophotographic photoconductor, comprising the steps of charging, light exposure, reversal development, and image transfer, the electrophotographic photoconductor comprising an electroconductive support, and a photoconductive layer formed thereon comprising a residual solvent component, and the electrophotographic photoconductor showing an residual potential change ratio of 200% or less, a sensitivity change ratio of 30% or less, and an electrostatic capacity change ratio of 30% or less.

The above-mentioned fifth object of the present invention can be achieved by an electrophotographic photoconductor comprising an electroconductive support, and a photoconductive layer formed thereon comprising a residual solvent component, which photoconductor is used with an electrophotographic image forming process comprising the steps of charging, light exposure, reversal development, and image transfer, with the electrophotographic photoconductor showing a residual potential change ratio of 200% or less.

The sixth object of the present invention can be achieved by an electrophotographic photoconductor comprising an electroconductive support, and a photoconductive layer formed thereon comprising a residual solvent component, which photoconductor is used with an electrophotographic image forming process comprising the steps of charging, light exposure, reversal development, and image transfer, with the electrophotographic photoconductor showing a sensitivity change ratio of 30% or less.

The seventh object of the present invention can be achieved by an electrophotographic photoconductor comprising an electroconductive support, and a photoconductive layer formed thereon comprising a residual solvent component, which photoconductor is used with an electrophotographic image forming process comprising the steps of charging, light exposure, reversal development, and image transfer, with the electrophotographic photoconductor showing an electrostatic capacity change ratio of 30% of less.

The eighth object of the present invention can be achieved by an electrophotographic photoconductor comprising an electroconductive support, and a photoconductive layer formed thereon comprising a residual solvent component, which photoconductor is used with an electrophotographic image forming process comprising the steps of charging, light exposure, reversal development, and image transfer, with the electrophotographic photoconductor showing a residual potential change ratio of 200% or less, a sensitivity change ratio of 30% or less, and an electrostatic capacity change ratio of 30% or less.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
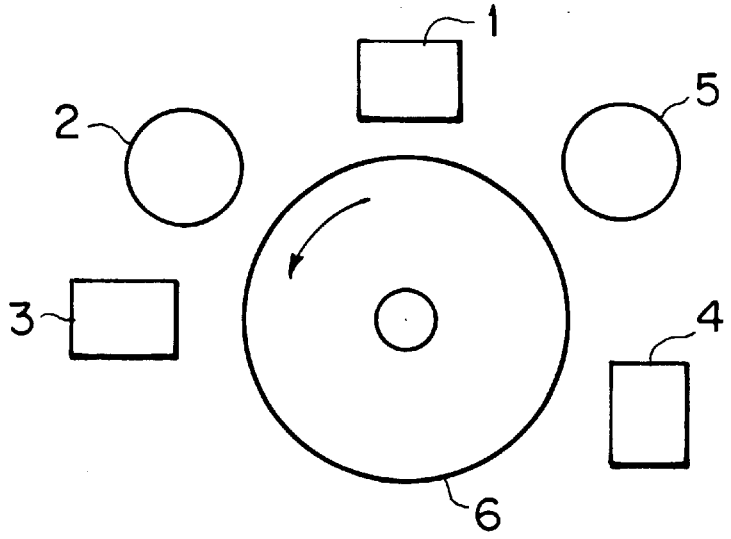
FIG. 1 is a schematic view which shows an apparatus for evaluating the fatigue characteristics of a photoconductor in the course of the electrophotographic image forming process according to the present invention.

In the electrophotographic image forming process comprising the charging step, light exposure step, reversal development step, and image transfer step, using an electrophotographic photoconductor comprising an electroconductive support and a photoconductive layer which is provided on the support and contains a residual solvent component, the above-discussed drawbacks are considered to result from the charge applied to the photoconductor in the course of the image transfer step so that the polarity of the image transfer charging is opposite to the polarity used at the charging step for sensitizing the photoconductor.

Charge carriers are injected into the portion of the photoconductor subjected to the image transfer charging. The charge carriers injected into the photoconductor are trapped at the interface between the adjacent layers of the photoconductor, for example, between the undercoat layer and the charge generation layer, between the charge generation layer and the charge transport layer, or the charge transport layer and the protective layer. In particular, by the influence of the solvent component remaining in the photoconductor, the charge carriers injected into the photoconductor at the image transfer step are not canceled before the subsequent charging step is initiated. Thus, the charge carriers tend to be accumulated in the photoconductive layer and remain trapped therein. In such a case, the charging potential of a light-exposed portion on the photoconductor is gradually decreased while the image forming process is repeated, with the result that the obtained character images become thicker.

When the residual potential change ratio of the photoconductor is 200% or less, the charge carriers can be restrained from injecting into the photoconductor even though the charging with the opposite polarity is applied to the photoconductor in the image transfer step. Thus, the potential of the light-exposed portion on the photoconductor can be stabilized, so that thickening of character images can be inhibited.

When the sensitivity change ratio of the photoconductor is 30% or less, the charge carriers can be restrained from injecting into the photoconductor even though the charging with the opposite polarity is applied to the photoconductor in the image transfer step. Thus, the decrease in the potential of a light-exposed portion can be prevented, so that abnormal stripe images can be inhibited from appearing on image transfer sheets.

When the electrostatic capacity change ratio is 30% or less, the charge carriers can be restrained from injecting into the photoconductor even though the charging with the opposite polarity is applied to the photoconductor in the image transfer step. Thus, the charging potential obtained by the first rotation of the photoconductor can be stabilized, so that high quality images with uniform image density can be obtained and high quality color images with excellent color reproduction can be obtained.

In the case where the image transfer charger is in contact with the photoconductor, to be more specific, in the form of an image transfer belt, image transfer roller, or intermediate image transfer belt, the injection of charge carriers into the photoconductor becomes conspicuous. Therefore, the electrophotographic image forming process according to the present invention is considered to be more effective when the image transfer charger is disposed in contact with the photoconductor.

In order to control the residual potential change ratio, the sensitivity change ratio, and the electrostatic capacity change ratio of the photoconductor as specified in the present invention, it is effective to minimize the number of sites on the interface between the adjacent layers in the photoconductor, where the charge carriers are readily trapped. For instance, when an undercoat layer, a photoconductive layer, which may comprise a charge generation layer and a charge transport layer, and a protective layer are successively provided on an electroconductive support in this order in the photoconductor, materials for use in the undercoat layer and materials for use in the charge generation layer such as a pigment, a binder resin, and a solvent may be appropriately selected, and the formulation for each layer may be properly controlled. Thus, the trap site at the interface between the undercoat layer and the single-layered photoconductive layer or the charge generation layer of the layered photoconductive layer can be effectively minimized. To prevent the charge carriers from being trapped into the interface between the charge generation layer and the charge transport layer, it is effective to appropriately select the above-mentioned materials for use in the charge generation layer and materials for use in the charge transport layer such as a charge transport material, a binder resin, and a solvent, and properly adjust the formulation for each layer. Further, with respect to the interface between the single-layered photoconductive layer or the charge transport layer of the layered photoconductive layer and the protective layer, it is important that the materials for use in the single-layered photoconductive layer or charge transport layer and materials for use in the protective layer such as a pigment, a binder resin and a solvent be appropriately selected with a care being paid to the formulation for each layer.

Furthermore, it is effective to control the surface roughness of each layer which can form the above-mentioned interface, and adjust the drying conditions after a coating liquid for the formation of each layer is coated.

In addition, to minimize the number of sites where the charge carriers are injected into the photoconductor, it is preferable to control the total concentration of the solvent remaining in the photoconductor in the range of 10 to 10,000 ppm, more preferably in the range of 100 to 1,000 ppm. A smaller concentration than the above-described range causes the residual stress of the layer to increase, so that the corresponding layer will easily peel off. On the other hand, a greater concentration than the above-described range has no effect on the reduction of sites where the charge carriers are injected into the photoconductor.

The concentration of the residual solvent in each layer is obtained by pyrolysis gas chromatography.

When the residual solvent comprises a halogen-free solvent, the durability of the photoconductor can be improved. More specifically, the abrasion resistance of the surface top layer of the photoconductor can be enhanced.

The injection of charge carriers into the photoconductor by the application of charge with the opposite polarity can be conveniently expressed by each of the fatigue characteristics of the photoconductor, that is, the residual potential change ratio, the sensitivity change ratio, and the electrostatic capacity change ratio.

FIG. 1 is a schematic view which sows an apparatus for evaluating the fatigue characteristics of the electrophotographic photoconductor according to the present invention.

In FIG. 1, a charger 1 for charging step, an LED 2 for erasing, a light exposure means 3, a charger 4, and an LED 5 for quenching are arranged around an electrophotographic photoconductor 6. The polarity of the charger 1 for sensitizing the photoconductor 6 is opposite to that of the charger 4.

By use of the apparatus as shown in FIG. 1, the fatigue characteristics of the photoconductor resulting from the charging with the opposite polarity at the image transfer step are evaluated from the following three viewpoints:

(1) Residual Potential Change Ratio

The photoconductor 6 is driven in rotation in a direction of an arrow, and first charged to 800 V using the charger 1, and the charged photoconductor 6 is exposed to light using the light exposure means 3 to cause light decay. The photoconductor 6 is allowed to stand for 30 seconds, and the potential of the light-exposed portion of the photoconductor 6 was measured. The residual potential thus obtained is referred to as an initial residual potential ($V_{30}$).

With the charger 1, the LED 2, the charger 4, and the LED 5 being turned on, charging and light exposure are repeated for 4 hours by rotating the photoconductor 6. After that, the charger 1, the LED 2, the charger 4, and the LED 5 are turned off. Immediately after that, the photoconductor 6 is charged to 800 V using the charger 1, and exposed to light using the light exposure means 3 to cause light decay. The photoconductor 6 is allowed to stand for 30 seconds, and the potential of the light-exposed portion of the photoconductor 6 was measured. The residual potential thus obtained is referred to as after-fatigue residual potential ($V'_{30}$). The residual potential change ratio is obtained by the following formula:

$$\text{Residual potential change ratio } (\%)=(V'_{30})/(V_{30})\times 100\%$$

(2) Sensitivity Change Ratio

The photoconductor 6 is driven in rotation in a direction of an arrow, and first charged to 800 V using the charger 1, and the charged photoconductor is exposed to light using the light exposure means 3 to cause light decay. The exposure required to reduce the potential of the light-exposed portion of the photoconductor 6 from 800 V to 100 V is obtained. This value of exposure is referred to as initial sensitivity ($S_0$).

With the charger 1, the LED 2, the charger 4, and the LED 5 being turned on, charging and light exposure are repeated for 4 hours by rotating the photoconductor 6. After that, the charger 1, the LED 2, the charger 4, and the LED 5 are turned off. Immediately after that, the photoconductor 6 is charged to 800 V using the charger 1, and exposed to light using the light exposure means 3 to cause light decay. The exposure required to reduce the potential of the light-exposed portion of the photoconductor 6 to 100 V is obtained. This value of exposure is referred to as after-fatigue sensitivity ($S_1$). The sensitivity change ratio is obtained by the following formula:

$$\text{Sensitivity change ratio } (\%)=(S_1)/(S_0)\times 100\%$$

(3) Electrostatic Capacity Change Ratio

The photoconductor 6 is driven in rotation in a direction of an arrow, and first charged to 800 V using the charger 1. The charging quantity (Q) required to obtain the surface potential of 800 V is obtained. The initial electrostatic capacity ($C_0$) is obtained by the following formula:

$$C_0=Q/V,$$

wherein Q is the charging quantity, and V is the surface potential of the photoconductor.

With the charger 1, the LED 2, the charger 4, and the LED 5 being turned on, charging and light exposure are repeated for 4 hours by rotating the photoconductor 6. After that, the charger 1, the LED 2, the charger 4, and the LED 5 are turned off. Immediately after that, the photoconductor 6 is charged to 800 V using the charger 1. The charging quantity (Q) required to obtain the surface potential of 800 V is obtained. The after-fatigue electrostatic capacity ($C_1$) is obtained in the same manner as mentioned above.

Thus, the electrostatic capacity change ratio can be expressed by the following formula:

$$\text{Electrostatic capacity change ratio } (\%)=(C_1)/(C_0)\times 100\%$$

Figure 2:
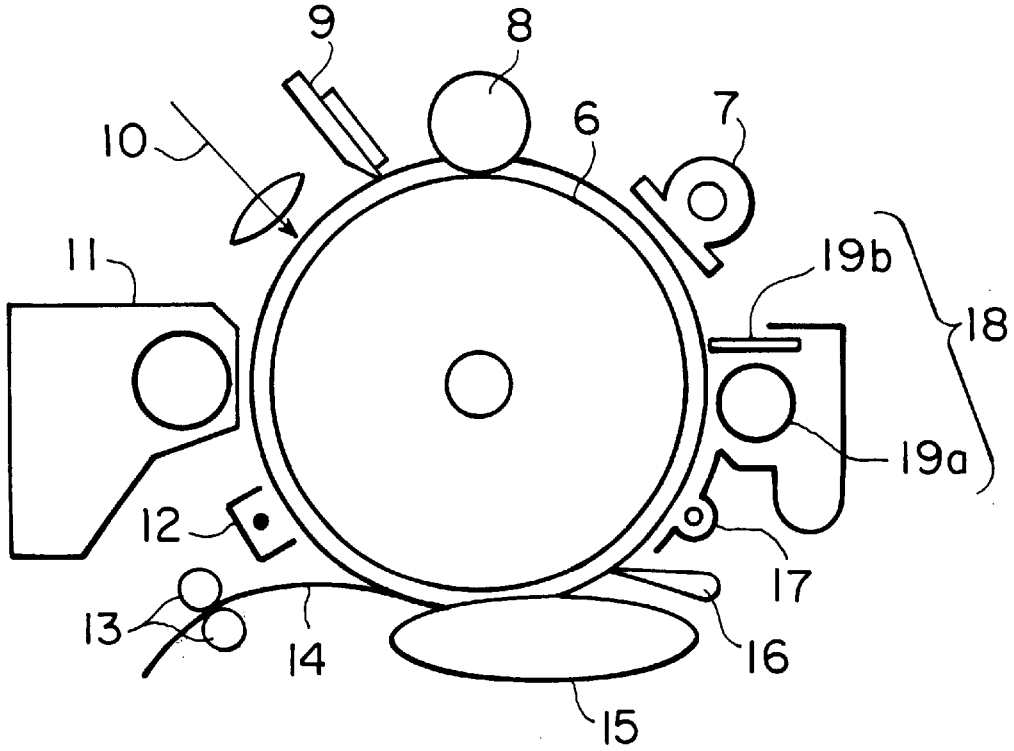
FIG. 2 is a schematic view which shows an electrophotographic image forming apparatus in explanation of the electrophotographic image forming process according to the present invention.

FIG. 2 is a schematic diagram which shows one example of the electrophotographic apparatus in explanation of the electrophotographic image forming process of the present invention.

As shown in FIG. 2, there are disposed a charger 8, an eraser 9, a light exposing unit 10, a development unit 11, an image transfer belt 15, a separator 16, a cleaning unit 18, and a quenching lamp 7 around an electrophotographic photoconductor 6 comprising an electroconductive layer and a photoconductive layer formed thereon. The cleaning unit 18 in FIG. 2 comprises a fur brush 19*a* and a cleaning blade 19*b*. When necessary, a pre-transfer charger 12, a pre-cleaning charger 17 may be arranged in such a configuration as shown in FIG. 2.

In FIG. 2, reference numeral 13 indicates resist rollers.

As the light source of the light exposing unit 10 and the quenching lamp 7, there can be employed fluorescent tube, tungsten lamp, halogen lamp, mercury vapor lamp, sodium light source, light emitting diode (LED), semiconductor laser (LD), electroluminescence (EL), and the like. Further, a desired wavelength can be obtained by use of various filters such as a sharp-cut filter, bandpass filter, a near infrared cut filter, dichloric filter, interference filter, and color conversion filter.

When the photoconductor is irradiated with light in the course of the image transfer step, quenching step, cleaning step, or pre-light exposure step, the above-mentioned light sources are usable.

The toner image formed on the photoconductor 6 obtained by reversal development using the development until 11 is transferred to a transfer sheet 14. At that time, all the toner particles deposited on the photoconductor 6 are not transferred to the transfer sheet 14. Some toner particles remain on the photoconductor 6. The remaining toner particles are removed from the photoconductor 6 using the fur brush 19*a* and the blade 19*b*. The cleaning of the photoconductor may be carried out only by use of a cleaning brush. As the cleaning brush, there can be employed a conventional fur brush and magnetic fur brush.

The development step and the quenching step may be carried out in the conventional manner.

The above-discussed units, such as the charging unit, light-exposing unit, development unit, image transfer unit, cleaning unit, and quenching unit may be independently fixed in the copying machine, facsimile machine, or printer. Alternatively, those units may be incorporated in one body as a cartridge. To be more specific, the cartridge containing therein the photoconductor, charging unit, light-exposing unit, development unit, image transfer unit, cleaning unit, and quenching unit may be detachably set in the above-mentioned electrophotographic image forming apparatus.

Figure 3:
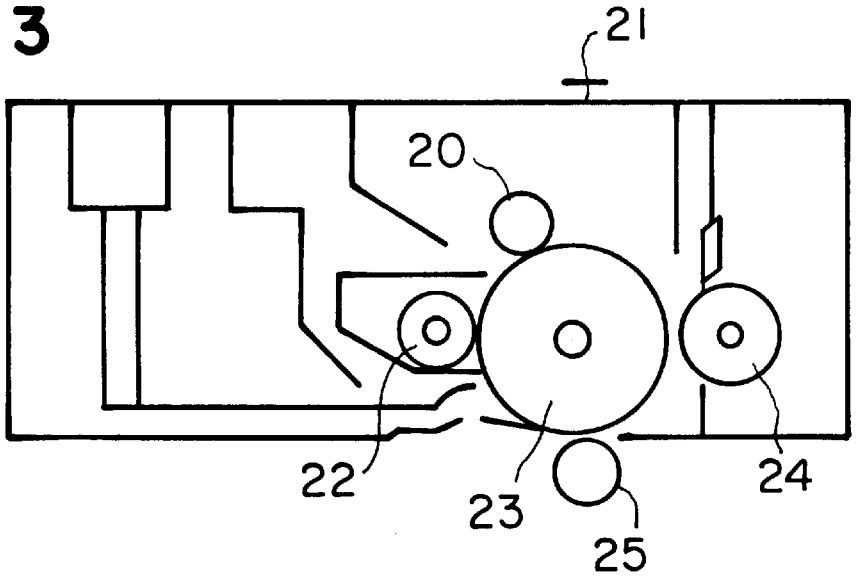
FIG. 3 is an electrophotographic photoconductor according to the present invention, which is held in a cartridge together with other units.

FIG. 3 is a schematic view which shows one example of the cartridge containing the electrophotographic image forming units. In FIG. 3, there are disposed a contact charger 20, a light exposing unit 21, a development roller 24, an image transfer roller 25, and a cleaning brush 22 around a photoconductor 23.

The structure of the electrophotographic photoconductor according to the present invention will now be explained with reference to FIG. 4 to FIG. 6.

Figure 4:
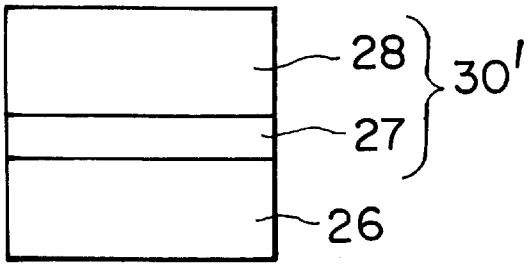
FIG. 4 is a schematic cross-sectional view which shows one example of an electrophotographic photoconductor according to the present invention.

FIG. 4 is a schematic cross-sectional view of one embodiment of an electrophotographic photoconductor. As show in FIG. 4, a charge generation layer 27 and a charge transport layer 28, which constitute a layered photoconductive layer 30', are successively provided on an electroconductive support 26.

Figure 5:
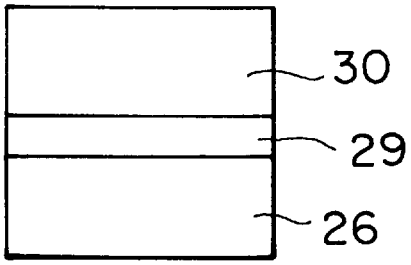
FIG. 5 is a schematic cross-sectional view which shows another example of an electrophotographic photoconductor according to the present invention.

FIG. 5 is a schematic cross-sectional view of another embodiment of an electrophotographic photoconductor. The photoconductor show in FIG. 5 comprises an electroconductive support 26, and an undercoat layer 29 and a photoconductive layer 30 which are successively overlaid on the electroconductive support 26 in this order. In this case, the photoconductive layer 30 may be a single-layered photoconductive layer or a layered photoconductor 30' as illustrated in FIG. 4.

Figure 6:
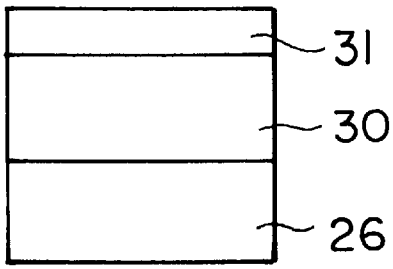
FIG. 6 is a schematic cross-sectional view which shows a further example of an electrophotographic photoconductor according to the present invention.

FIG. 6 is a schematic cross-sectional view of a further embodiment of an electrophotographic photoconductor. The photoconductor show in FIG. 6 comprises an electroconductive support 26, and a photoconductive layer 30 and a protective layer 31 which are successively overlaid on the electroconductive support 26 in this order. In this case, the photoconductive layer 30 may be a single-layered photoconductive layer or a layered photoconductor 30' as illustrated in FIG. 4.

The electroconductive support 26 may exhibit electroconductive properties, for example, have a volume resistivity of $10^{10}$ Ω or less. The electroconductive support 26 can be prepared by coating metals such as aluminum, nickel, chromium, nichrome, copper, silver, gold, and platinum, or metallic oxides such as tin oxide and indium oxide on a plastic film or a sheet of paper, which may be in the cylindrical form, by deposition or sputtering method. Alternatively, a plate of aluminum, aluminum alloys, nickel, or stainless steel may be formed into a tube by drawing and ironing (E.I.) method, impact ironing (I.I.) method, extrusion or pultrusion method. Subsequently, the tube thus obtained may be subjected to surface treatment such as cutting, superfinishing or abrasion to prepare the electroconductive support 26 for use in the photoconductor of the present invention.

The photoconductive layer 30 may be a single-layered structure or a layered structure.

The layered photoconductive layer 30' comprises a charge generation layer 27 and a charge transport layer 28. The charge generation layer 27 will be first explained in detail.

The charge generation layer 27 comprises a charge generation material, optionally in combination with a binder resin. The charge generation material includes an inorganic material and an organic material.

Specific examples of the inorganic charge generation material are crystalline selenium, amorphous selenium, selenium—tellurium, selenium—tellurium—halogen, selenium—arsenic compound, and a-silicon (amorphous silicon). In particular, when the above-mentioned a-silicon is employed as the charge generation material, it is preferable that the dangling bond be terminated with hydrogen atom or a halogen atom, or be doped with boron atom or phosphorus atom.

Specific examples of the conventional organic charge generation materials for use in the present invention are phthalocyanine pigments such as metallo-phthalocyanine and metal-free phthalocyanine, azulenium salt pigments, squaric acid methyne pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryl oxadiazole skeleton, azo pigments having a distyryl carbazole skeleton, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoid pigments, and bisbenzimidazole pigments.

Those charge generation materials may be used alone or in combination.

In the present invention, it is preferable that the charge generation material comprise X-type phthalocyanine pigment and titanyl phthalocyanine pigment because such a phthalocyanine pigment has an effect on the decrease of the above-discussed residual potential change ratio.

In particular, it is preferable that the titanyl phthalocyanine pigment exhibit at least one diffraction peak at 27.2±0.2° in terms of a Bragg angle of 2θ in an X-ray diffraction spectrum using a Cu—Kα ray with a wavelength of 1.54 Å.

Examples of the binder resin for use in the charge generation layer 27 are polyamide, polyurethane, epoxy resin, polyketone, polycarbonate, silicone resin, acrylic resin, poly(vinyl butyral), poly(vinylformal), poly(vinyl ketone), polystyrene, poly-N-vinylcarbazole and polyacrylamide. Those binder resins may be used alone or in combination. Further, the charge generation layer 27 may further comprise a charge transport material to be described later.

The charge generation layer 27 can be formed by vacuum thin-film forming method or casting method using a dispersion system.

The vacuum thin-film forming method includes vacuum deposition, glow discharge, ion plating, sputtering, reactive sputtering, and chemical vapor deposition (CVD). The above-mentioned inorganic and organic charge generation materials are applicable to the vacuum thin-film forming method.

When the charge generation layer 27 is formed by the casting method, the above-mentioned inorganic or organic charge generation material is dispersed in a proper solvent such as tetrahydrofuran, cyclohexanone, dioxane, dichloroethane, or butanone, optionally in combination with a binder agent, in a ball mill, an attritor or a sand mill. The dispersion thus obtained may appropriately be diluted to prepare a coating liquid for the charge generation layer 27. The coating of the coating liquid for the charge generation layer 27 is achieved by dip coating, spray coating or beads coating.

The proper thickness of the charge generation layer 27 thus formed is in the range of about 0.01 to 5 μm, preferably in the range of 0.05 to 2 μm.

The charge transport layer 28 will now be explained in detail.

To provide the charge transport layer 28, a charge transport material and a binder resin are dissolved or dispersed in an appropriate solvent to prepare a coating liquid, and the coating liquid thus prepared is coated and dried. When necessary, the charge transport layer 28 may further comprise a plasticizer and a leveling agent.

The charge transport material includes a positive hole transport material and an electron transport material.

Examples of the electron transport material are conventional electron acceptor compounds such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, and 1,3,7-trinitrodibenzothiophene-5,5-dioxide. Those electron transport materials may be used alone or in combination.

Examples of the positive hole transport material include electron donor compounds such as oxazole derivatives, oxadiazole derivatives, imidazole derivatives, triphenylamine derivatives, 9-(p-diethylaminostyryl anthracene), 1,1-bis-(4-dibenzylaminophenyl) propane, styryl anthracene, styryl pyrazoline, phenylhydrazone, α-phenylstilbene derivatives, thiazole derivatives, triazole derivatives, phenazine derivatives, acridine derivatives, benzofuran derivatives, benzimidazole derivatives, and thiophene derivatives. Those positive hole transport materials may be used alone or in combination.

Examples of the binder resin for use in the charge transport layer 28 include polycarbonate (bisphenol A type, bispheno Z type, and bisphenol C type), polyester, methacrylic resin, acrylic resin, polyethylene, vinyl chloride, vinyl acetate, polystyrene, phenolic resin, epoxy resin, polyurethane, poly(vinylidene chloride), alkyl resin, silicone resin, poly(vinylcarbazole), poly(vinyl butyral), poly(vinyl formal), polyacrylate, polyacrylamide, and phenoxy resin.

In particular, a polycarbonate resin comprising a structure of bisphenol A, bisphenol C, or bisphenol Z as a repeat unit is preferably employed as the binder resin in the charge transport layer 28. Those binder resins may be used alone or in combination.

A high-molecular weight charge transport material provided with functions both as the binder resin and the charge transport material may be used as the binder resin in the charge transport layer 28. Examples of the above-mentioned high-molecular weight charge transport material are as follows:

(a) Polymer having carbazole ring at the main chain and/or side chain: poly-N-vinylcarbazole, and compounds disclosed in Japanese Laid-Open Patent Applications 50-82056, 54-9632, 54-11737, and 4-183719.

(b) Polymer having hydrazone structure at the main chain and/or side chain: compounds disclosed in Japanese Laid-Open Patent Applications 57-78402 and 3-50555.

(c) Polysilylene: compounds disclosed in Japanese Laid-Open Patent Applications 63-285552, 5-19497, and 5-70595.

(d) Polymer having tertiary amine structure at the main chain and/or side chain: N,N-bis(4-methylphenyl)-4-aminopolystyrene, and compounds disclosed in Japanese Laid-Open Patent Applications 1-13061, 1-19049, 1-1728, 1-105260, 2-167335, 5-66598, and 5-40350.

(e) Other polymers: nitropyrene—formaldehyde condensation polymer, and compounds disclosed in Japanese Laid-Open Patent Applications 51-73888 and 56-150749.

The high-molecular weight charge transport material for use in the present invention is not limited to the above-mentioned polymers. There can be employed various copolymers, block polymers, graft polymers, and star polymers, each comprising any of the conventional monomers. In addition, crosslinked polymers having an electron donating group, for example, as disclosed in Japanese Laid-Open Patent application 3-109406, are also usable.

It is preferable that the thickness of the charge transport layer 28 be in the range of about 5 to 100 μm.

As mentioned above, the charge transport layer may further comprise a plasticizer and a leveling agent.

Any plasticizer used for general resins, such as dibutyl phthalate or dioctyl phthalate may be added to the charge transport layer coating liquid as it is. In this case, it is proper that the amount of plasticizer be in the range of 0 to about 30 wt % of the total weight of the binder resin for use in the charge transport layer 28.

As the leveling agent for use in the charge transport layer coating liquid, there can be employed polymers and oligomers having a perifluoroalkyl group on the side chain thereof. The proper amount of leveling agent is in the range of 0 to about 1 wt % of the total weight of the binder resin for use in the charge transport layer 28.

The photoconductive layer 30 with a single-layered structure will now be described in detail.

When the single-layered photoconductive layer 30 is provided on the electroconductive support 26 by the casting method, a function-separating photoconductive layer which comprises a charge generation material and a charge transport material is preferably employed. Any of the above-mentioned charge generation materials and charge transport materials are usable.

The single-layered photoconductive layer 30 may by formed by dissolving and dispersing the charge generation material and the charge transport material together with a binder resin in a proper solvent to prepare a coating liquid, and coating the above-mentioned coating liquid, for example, on the electroconductive support 26, and then drying the coated liquid. In this case, the plasticizer and leveling agent may be contained in the photoconductive layer 30.

As the binder resin for use in the single-layered photoconductive layer 30, the same binder resin as mentioned in the charge transport layer 28 may be used alone, or in combination with the same binder resin as mentioned in the charge generation layer 27.

To be more specific, the charge generation material, charge transport material, and binder resin are dispersed in a proper solvent such as tetrahydrofuran, cyclohexanone, dioxane, dichloroethane or butanone, using a ball mill, an attritor or a sand mill. The dispersion thus obtained may appropriately be diluted to prepare a coating liquid for the photoconductive layer 30. The coating liquid for the photoconductive layer 30 may be coated by dip coating, spray coating or beads coating, and then dried.

Furthermore, a single-layered photoconductive layer comprising a eutectic complex of pyrylium dye and bisphenol A type polycarbonate, with the charge transport material being added thereto, can also be prepared by any of the above-mentioned coating methods using a proper solvent.

It is preferable that the single-layered photoconductive layer 30 be in the range of about 5 to 100 μm.

In the electrophotographic photoconductor according to the present invention, an undercoat layer 29 may be interposed between the electroconductive support 26 and the photoconductive layer 30, as shown in FIG. 5, and between the electroconductive support 26 and the charge generation layer 27 in the layered photoconductive layer 30' as shown in FIG. 4. The undercoat layer 29 is provided in order to improve the adhesion of the single-layered photoconductive layer 30 (or the charge generation layer 27 of the layered photoconductive layer 30') to the support 26, prevent the occcurrence of moiré, and improve the coating performance of the photoconductive layer 30 (or the charge generation layer 27).

The undercoat layer 29 comprises a resin as the main component. The photoconductive layer is provided on the undercoat layer by coating method using a solvent, so that it is desirable that the resin for use in the undercoat layer 29 have high resistance against generally used organic solvents.

Preferable examples of the resin for use in the undercoat layer 29 include water-soluble resins such as poly(vinyl alcohol), casein, and sodium polyacrylate; alcohol-soluble resins such as copolymer nylon and methoxymethylated nylon; and hardening resins with three-dimensional network such as polyurethane, melamine resin, alkyd-melamine resin and epoxy resin.

The undercoat layer 29 may further comprise finely-divided particles of metallic oxides such as titanium oxide, silica, alumina, zirconium oxide, tin oxide, and indium oxide, metallic sulfides; and metallic nitrides.

The undercoat layer 29 can be provided on the electroconductive support 26 by the same coating method as previously mentioned in the description of the photoconductive layer, using an appropriate solvent.

The undercoat layer 29 for use in the present invention may be a metallic oxide layer prepared by the sol-gel processing using a coupling agent such as silane coupling agent, titanium coupling agent or chromium coupling agent.

Furthermore, to prepare the undercoat layer 29, $Al_2O_3$ may be deposited on the electroconductive support 26 by anodizing process, or an organic material such as polyparaxylylene (parylene), or inorganic materials such as SiO, $SnO_2$, $TiO_2$, ITO and $CeO_2$ may be vacuum-deposited on the electroconductive support 26.

It is preferable that the thickness of the undercoat layer 29 be in the range of 0 to 5 μm.

As shown in FIG. 6, the electrophotographic photoconductor according to the present invention may further comprise a protective layer 31 which is provided on the photoconductive layer 30 to protect the surface of the photoconductor. The protective layer 31 may be provided on the layered photoconductive layer 30'.

The protective layer 31 can be provided by dissolving or dispersing a high-molecular weight charge transport material in a proper solvent to prepare a coating liquid, and coating and drying the above-mentioned coating liquid on the photoconductive layer.

Examples of the solvent used for preparation of the coating liquid for the protective layer 31 are tetrahydrofuran, dioxane, toluene, monochlorobenzene, dichloroethane, methylene chloride, and cyclohexanone.

The protective layer 31 may further comprise an electrically insert binder resin.

Examples of such a resin for use in the protective layer 31 are ABS resin, ACS resin, copolymer of olefin and vinyl monomer, chlorinated polyether, allyl, resin, polyacetal, polyamide, polyamideimide, polyacrylate, polyallyl solfone, polybutyelene, polybutylene terephthalate, polycarbonate, polyether sulfone, polyethylene, poly(ethylene terephthalate), polyimide, acrylic resin, polymethyl pentene, polypropylene, polyphenylene oxide, polysulfone, polystyrene, AS resin, butadiene—sytrene copolymer, polyurethane, poly(vinyl chloride), and epoxy resin.

The protective layer 31 may be prepared by subjecting a mixture of curable resin and a curing agent to curing treatment. In particular, the polycarbonate resin comprising the above-discussed repeat unit is also preferably employed for the formation of the protective layer 31.

The protective layer 31 may further comprise an organic or inorganic filler to improve the wear resistance, surface resistance, and surface energy. The filler material for use in the protective layer 31 may be appropriately selected depending upon the purpose.

Examples of the organic filler for use in the protective layer 31 include a fluorine-containing resin powder, such as polytetrafluoroethylene, silicone resin powder, and a carbon powder. In particular, the fluorine-containing resin powder is preferably used in the present invention.

Examples of the inorganic filler for use in the protective layer 31 include finely-divided electroconductive particles of metals such as copper, tin, aluminum, and indium; metallic oxides such as tin oxide, zinc oxide, titanium oxide, indium oxide, antimony oxide, bismuth oxide, tin oxide doped with antimony, and indium oxide coped with tin; and finely-divided particles of potassium titanate. The finely-divided electroconductive particles of metals and metallic oxides are preferably used for the filler in the protective layer 31.

Those fillers may be used alone or in combination.

The above-mentioned filler may be dispersed in the coating liquid for protective layer by use of a proper dispersion mixer. It is preferable that the average particle size of filler for use in the protective layer 31 be 0.5 $\mu$or less, more preferably 0.2 $\mu$m or less in light of the transmittance of the protective layer 31.

The protective layer 31 may further comprise a plasticizer and a leveling agent. The same plasticizers and leveling agents as mentioned in the description of the charge transport layer 28 are usable for the protective layer 31.

The protective layer 31 can be formed by the conventional coating method. The thickness of the protective layer 31 is preferably in the range of about 0.5 to 10 $\mu$m.

The protective layer 31 may further comprise a silicone oil for decreasing the surface energy so as to improve the wear resistance of the photoconductor.

In the electrophotographic photoconductor o the present invention, an antioxidant may be contained in any layer that contains an organic material therein in order to improve the environmental resistance, to be more specific, to prevent the decrease of photosensitivity. In particular, satisfactory results can be obtained when the antioxidant is added to the layer which comprises the charge transport material.

Examples of the antioxidants for use in the present invention are as follows:

(1) Monophenol compounds:

2,6-di-t-butyl-p-cresol, butylated hydroxyanisole, 2,6-di-t-butyl-4-ethylphenol, and stearyl-β-(3,5-di-t-butyl-4-hydroxyphenyl)propionate.

(2) Bisphenol compounds:

2,2'-methylene-bis-(4-methyl-6-t-butylphenyl), 2,2'-methylene-bis-(4-ethyl-6-t-butylphenol), 4,4'-thiobis-(3-methyl-6-t-butylphenol), and 4,4'-butylidenebis-(3-methyl-6-t-butylphenol).

(3) Polymeric phenol compounds:

1,1,3-tris-(2-methyl-4-hydroxy-5-t-butylphenyl)-butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, and tocophenol.

(4) Paraphenylenediamine compounds:

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

(4) Hydroquinone compounds:

2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

(6) Organic sulfur-containing compounds:

Dilauryl-3,3'-thiodipropionate, disteary-3,3'-thiodipropionate, and ditetradecyl-3,3'-thiodipropionate.

(7) Organic phosphorus-containing compounds:

Triphenylphosphine, tri(nonylphenyl)phosphine, tri (dinonylphenyl)phosphine, tricresylphosphine, and tri(2,4-dibutylphenoxy)phosphine.

The commercially available antioxidants for rubbers, plastic materials, and fats and oils are available as the above-mentioned compounds (1) to (7).

It is preferable that the amount of antioxidant be in the range of 0.1 to 100 parts by weight, more preferably in the range of 2 to 30 parts by weight, to 100 parts by weight of the charge transport material.

Other features of this invention will become apparent in the course of the following description of exemplary embodiments, which are given for illustration of the invention and are not intended to be limiting thereof.

EXAMPLE 1

<Fabrication of Electrophotographic Photoconductor>

[Formation of charge generation layer]

A coating liquid with the following formulation was coated on the outer surface of an aluminum drum with a diameter of 30 mm, and dried at 110° C. for 20 minutes. Thus, a charge generation layer with a thickness of about 0.3 $\mu$m was provided on the aluminum drum.

| | Parts by Weight |
|---|---|
| Charge generation material of the following formula: | 2.5 |

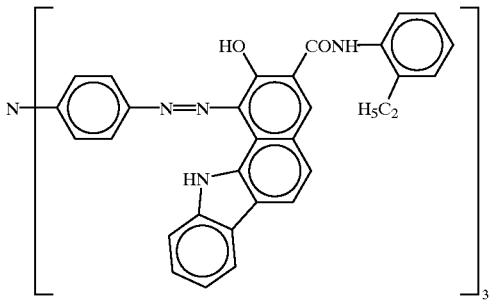

| | |
|---|---|
| X-type metal-free phthalocyanine | 2.5 |
| Poly(vinyl butyral) (Trademark "XYHL", made by Union Carbide Japan K.K.) | 2 |
| Cyclohexanone | 200 |
| Tetrahydrofuran | 200 |

A coating liquid with the following formulation was coated on the above prepared charge generation layer, and dried at 100° C. for 20 minutes. Thus, a charge transport layer with a thickness of about 20 μm was provided on the charge generation layer..

| | Parts by Weight |
|---|---|
| Polyalylate resin (Trademark "U-polymer U-100", made by Unitika, Ltd.) | 10 |
| Charge transport material of the following formula: | 7 |

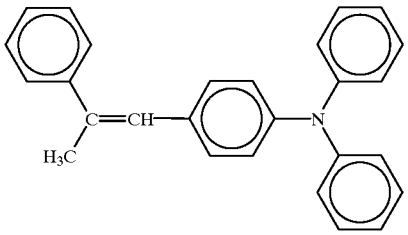

| | |
|---|---|
| Methylene chloride | 90 |

After the charge transport layer was formed on the charge generation layer, annealing was carried out at 120° C. for 20 minutes. Thus, an electrophotographic photoconductor No. 1 according to the present invention was fabricated.

EXAMPLE 2

<Fabrication of Electrophotographic Photoconductor>

[Formation of undercoat layer]

A coating liquid with the following formulation was coated on the outer surface of an aluminum drum with a diameter of 30 mm, and dried at 130° C. for 20 minutes. Thus, as undercoat layer with a thickness of about 3.5 μm was provided on the aluminum drum so that the surface roughness of the undercoat layer was 0.6 μm after coated in terms of the ten-point mean roughness (Rz) defined in JIS B 0601.

| | Parts by Weight |
|---|---|
| Alkyd resin solution (Trademark "Beckolite M-6401-50", made by Dainippon Ink & Chemicals, Incorporated) | 375 |
| Melamine resin solution (Trademark "Super Beckamine G821-60", made by Dainippon Ink & Chemicals, Incorporated) | 210 |
| Titanium dioxide (Trademark "Tipaque CR-EL", made by Ishihara Sangyo Kaisha, Ltd.) | 1250 |
| 2-butanone | 7800 |

[Formation of charge generation layer]

A coating liquid with the following formulation was coated on the above prepared undercoat layer, and dried at 110° C. for 20 minutes. Thus, a charge generation layer with a thickness of about 0.3 μm was provided on the undercoat layer.

| | Parts by Weight |
|---|---|
| Charge generation material of the following formula: | 5 |

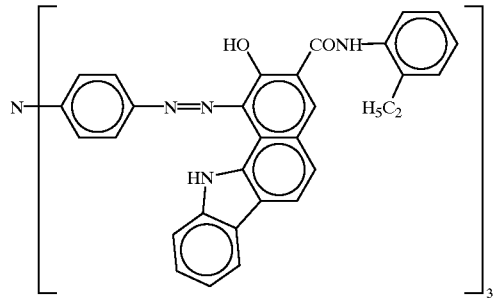

| | |
|---|---|
| Poly(vinyl butyral) (Trademark "XYHL", made by Union Carbide Japan K.K.) | 2 |
| Cyclohexanone | 200 |
| Tetrahydrofuran | 200 |

A coating liquid with the following formulation was coated on the above prepared charge generation layer, and dried at 100° C. for 20 minutes. Thus, a charge transport layer with a thickness of about 20 μm was provided on the charge generation layer.

| | Parts by Weight |
|---|---|
| Polyalylate resin (Trademark "U-polymer U-100", made by Unitika, Ltd.) | 10 |
| Charge transport material of the following formula: | 7 |

-continued

| | Parts by Weight |
|---|---|
| 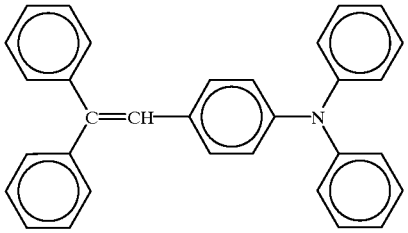 | |
| Methylene chloride | 90 |

Thus, an electrophotographic photoconductor No. 2 according to the present invention was fabricated.

EXAMPLE 3

<Fabrication of Electrophotographic Photoconductor>

[Formulation of charge generation layer]

A coating liquid with the following formulation was coated on the outer surface of an aluminum drum with a diameter of 30 mm by dip coating, and dried at 110° C. for 20 minutes. Thus, a charge generation layer with a thickness of about 0.3 μm was provided on the aluminum drum.

| | Parts by Weight |
|---|---|
| Charge generation material of the following formula: | 5 |
| 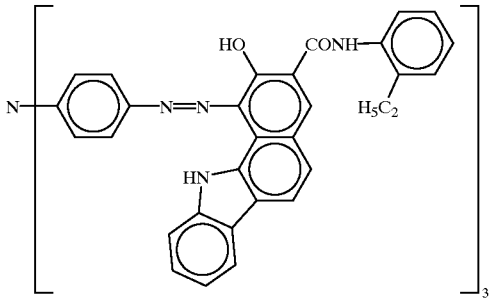 | |
| Poly(vinyl butyral) (Trademark "XYHL", made by Union Carbide Japan K.K.) | 2 |
| Cyclohexanone | 200 |
| Tetrahydrofuran | 200 |

A coating liquid with the following formulation was coated on the above prepared charge generation layer by dip coating, and dried at 120° C. for 20 minutes. Thus, a charge transport layer with a thickness of about 20 μm was provided on the charge generation layer.

| | Parts by Weight |
|---|---|
| Polyalylate resin (Trademark "U-polymer U-100", made by Unitika, Ltd.) | 10 |
| Charge transport material of the following formula: | 7 |
| 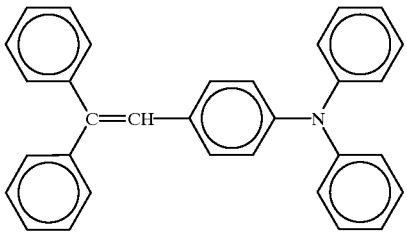 | |
| Methylene chloride | 90 |

A coating liquid with the following formulation was coated on the above prepared charge transport layer by spray coating, and dried at 120° C. for 20 minutes. Thus, a protective layer with a thickness of about 3 μm was provided on the charge transport layer.

| | Parts by Weight |
|---|---|
| Bisphenol C type polycarbonate | 10 |
| Charge transport material of the following formula: | 5 |
| 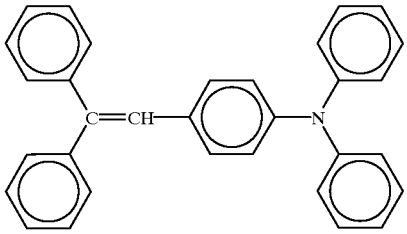 | |
| Methylene chloride | 500 |

Thus, an electrophotographic photoconductor No. 3 according to the present invention was fabricated.

EXAMPLE 4

The procedure for fabrication of the electrophotographic photoconductor No. 3 in Example 3 was repeated except that the coating liquid for protective layer employed in Example 3 was replaced by a coating liquid with the following formulation:

(Formulation of protective layer coating liquid)

| | Parts by Weight |
|---|---|
| Bisphenol C type polycarbonate | 10 |
| Tin oxide | 5 |
| Methylene chloride | 500 |

Thus, an electrophotographic photoconductor No. 4 according to the present invention was fabricated.

EXAMPLE 5

The procedure for fabrication of the electrophotographic photoconductor No. 3 in Example 3 was repeated except that the coating liquid for protective layer employed in Example 3 was replaced by a coating liquid with the following formulation:

(Formulation of protective layer coating liquid)

| | Parts by Weight |
|---|---|
| Bisphenol Z type polycarbonate | 10 |
| Finely-divided particles of polyfluoroethylene | 6 |
| Charge transport material of the following formula: | 5 |

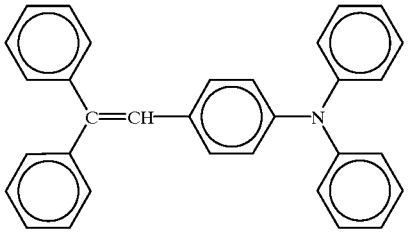

| | |
|---|---|
| Methylene chloride | 500 |

Thus, an electrophotographic photoconductor No. 5 according to the present invention was fabricated.

EXAMPLE 6

The procedure for fabrication of the electrophotographic photoconductor No. 1 in Example 1 was repeated except that the coating liquid for charge generation layer employed in Example 1 was replaced by a coating liquid with the following formulation:

(Formulation of charge generation layer coating liquid)

| | Parts by Weight |
|---|---|
| X-type metal-free phthalocyanine | 3 |
| Poly(vinyl butyral) | 2 |
| Tetrahydrofuran | 50 |
| 4-methyl-2-pentanone | 90 |

Thus an electrophotographic photoconductor No. 6 according to the present invention was fabricated.

EXAMPLE 7

The procedure for fabrication of the electrophotographic photoconductor No. 1 in Example 1 was repeated except that the coating liquid for charge generation layer employed in Example 1 was replaced by a coating liquid with the following formulation:

(Formulation of charge generation layer coating liquid)

| | Parts by Weight |
|---|---|
| TiO-phthalocyanine | 3 |
| Poly(vinyl butyral) | 2 |
| Tetrahydrofuran | 50 |
| 4-methyl-2-pentanone | 90 |

Thus, an electrophotographic photoconductor No. 7 according to the present invention was fabricated.

Figure 7:
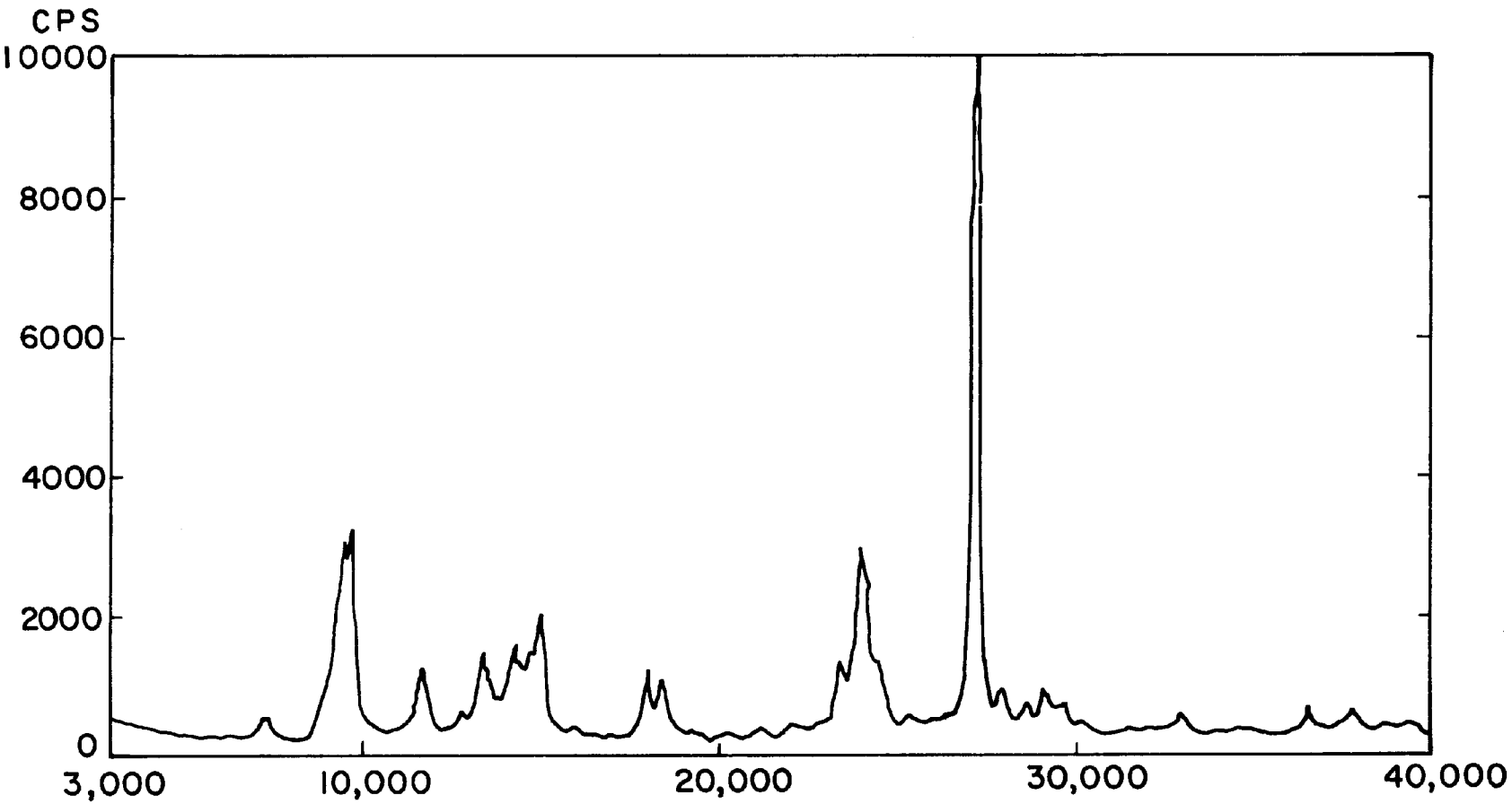
FIG. 7 is an X-ray diffraction spectrum of TiO-phthalocyanine pigment in the form of a powder which is used for a charge generation layer coating liquid in Example 7.

The X-ray diffraction spectrum of the TiO-phthalocyanine employed in the charge generation layer coating liquid is shown in FIG. 7.

EXAMPLE 8

The procedure for fabrication of the electrophotographic photoconductor No. 1 in Example 1 was repeated except that methylene chloride for use in the coating liquid for charge transport layer employed in Example 1 was replaced by tetrahydrofuran.

Thus, an electrophotographic photoconductor No. 8 according to the present invention was fabricated.

EXAMPLE 9

The procedure for fabrication of the electrophotographic photoconductor No. 1 in Example 1 was repeated except that methylene chloride for use in the coating liquid for charge transport layer employed in Example 1 was replaced by dioxane.

Thus, an electrophotographic photoconductor No. 9 according to the present invention was fabricated.

COMPARATIVE EXAMPLE 1

The procedure for fabrication of the electrophotographic photoconductor No. 1 in Example 1 was repeated except that the coating liquid for charge transport layer employed in Example 1 was replaced by a coating liquid with the following formulation, and the annealing was not carried out after formation of the charge transport layer.

(Formulation of charge transport layer coating liquid)

| | Parts by Weight |
|---|---|
| Polyalylate resin | 10 |
| Charge transport material of the following formula: | 15 |

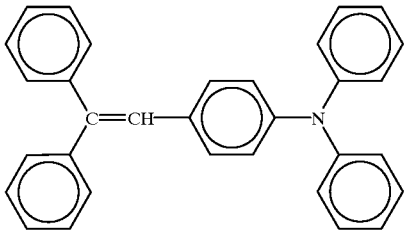

| | |
|---|---|
| Methylene chloride | 90 |

Thus, a comparative electrophotographic photoconductor No. 1 was fabricated.

COMPARATIVE EXAMPLE 2

[Formation of undercoat layer]

The procedure for formation of the undercoat layer in Example 2 was repeated except that the amount of titanium dioxide for use in the undercoat layer coating liquid was changed from 1250 to 2500 parts by weight, and that the undercoat layer was provided on the aluminum drum so as to have a surface roughness of 3.0 μm in terms of the ten-point mean roughness (Rz) defined in JIS B 0601 by controlling the dispersion time of the coating liquid. Thus, an undercoat layer with a thickness of about 3.5 μm was provided on the aluminum drum.

[Formation of charge generation layer]

The procedure for formation of the charge generation layer in Example 2 was repeated except that the drying temperature of the coated liquid was changed from 110 to 130° C. Thus, a charge generation layer with a thickness of about 0.3 μm was provided on the undercoat layer.

[Formation of charge transport layer]

The procedure for formation of the charge transport layer in Example 2 was repeated except that the drying time of the coated liquid was changed from 20 to 10 minutes. Thus, a charge transport layer with a thickness of about 20 μm was provided on the charge generation layer.

Thus, a comparative electrophotographic photoconductor No. 2 was fabricated.

COMPARATIVE EXAMPLE 3

[Formation of charge generation layer]

A charge generation layer with a thickness of about 0.3 μm was provided on the aluminum drum in the same manner as in Example 3.

[Formation of charge transport layer]

The procedure for formation of the charge transport layer in Example 3 was repeated except that the drying temperature of the coated liquid was changed from 120 to 100° C. Thus, a charge transport layer with a thickness of about 20 μm was provided on the charge generation layer.

[Formation of protective layer]

A coating liquid with the following formation was coated on the above prepared charge transport layer by spray coating, and dried at 120° C. for 20 minutes. Thus, a protective layer with a thickness of about 3 μm was provided on the charge transport layer.

| | Parts by Weight |
|---|---|
| Bisphenol Z type polycarbonate | 10 |
| Charge transport material of the following formula: | 15 |
| 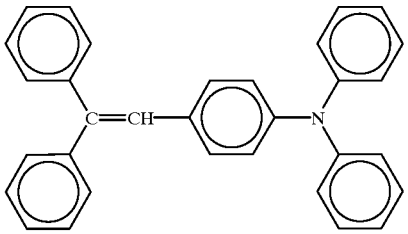 | |
| Methylene chloride | 90 |

Thus, a comparative electrophotographic photoconductor No. 3 was fabricated.

Each of the electrophotographic photoconductors No. 1 to No. 9 according to the prevent invention and the comparative electrophotographic photoconductors No. 1 to No. 3 was set in the apparatus for evaluating the fatigue characteristics as shown in FIG. 1. Then, the residual potential change ratio, the sensitivity change ratio, and the electrostatic capacity change ratio was separately measured by the previously mentioned methods. The results of the above-mentioned evaluations are respectively shown in TABLE 1, TABLE 2 AND TABLE 3.

In addition, each photoconductor was set in an electrophotographic image forming apparatus as shown in FIG. 2, and the charging potential was set to 850 V and the potential after light exposure was set to 150 V. After 100 copies was continuously made, it was visually observed whether the obtained character images became thicker or not. The results are shown in TABLE 1.

Further, the presence of residual solvent component in each layer of the photoconductor was investigated by pyrolysis gas chromatography, and the total concentration of the solvent was obtained. The results are also shown in TABLE 1.

TABLE 1

| | Residual Potential Change Ratio (%) | Thickening of Character Image | Concentration of Residual Solvent (ppm) |
|---|---|---|---|
| Ex. 1 | 200 | slightly observed. | 12 |
| Ex. 2 | 125 | not observed. | 10000 |
| Ex. 3 | 150 | not observed. | 5000 |
| Ex. 4 | 160 | not observed. | 5000 |
| Ex. 5 | 150 | not observed. | 5000 |
| Ex. 6 | 70 | not observed. | 20 |
| Ex. 7 | 60 | not observed. | 20 |
| Ex. 8 | 150 | not observed. | 2500 |
| Ex. 9 | 150 | not observed. | 2000 |
| Comp. Ex. 1 | 220 | Conspicuously observed. | 12000 |
| Comp. Ex. 2 | 230 | Conspicuously observed. | 20000 |
| Comp. Ex. 3 | 300 | Conspicuously observed. | 12000 |

With each photoconductor being set in the electrophotographic image forming apparatus as shown in FIG. 2, 100 copies were continuously made using 100 sheets of post card size. Thereafter, a copy was made on a sheet of A4 size. It was visually observed whether there occurred on the A4 size paper an abnormal black stripe image corresponding to the outline of the sheet of post card size, or not. The results are shown in TABLE 2.

TABLE 2

| | Sensitivity Change Ratio (%) | Abnormal Black Stripe |
|---|---|---|
| Ex. 1 | 30 | Slightly observed. |
| Ex. 2 | 20 | Not observed. |
| Ex. 3 | 20 | Not observed. |
| Ex. 4 | 25 | Not observed. |
| Ex. 5 | 25 | Not observed. |
| Ex. 6 | 20 | Not observed. |
| Ex. 7 | 10 | Not observed. |
| Ex. 8 | 25 | Not observed. |
| Ex. 9 | 25 | Not observed. |
| Comp. Ex. 1 | 40 | Conspicuously observed. |

TABLE 2-continued

| | Sensitivity Change Ratio (%) | Abnormal Black Stripe |
|---|---|---|
| Comp. Ex. 2 | 50 | Conspicuously observed. |
| Comp. Ex. 3 | 40 | Conspicuously observed. |

With each photoconductor being set in the electrophotographic image forming apparatus as shown in FIG. 2, the charging potential was set to 850 V and the potential obtained after light exposure was set to 150 V. After 100 copies were continuously made, the copying operation was stopped, and allowed to stand for one minute, 10 minutes, or 30 minutes. After such intermission, the charging potential ($V_D$) and the potential obtained after light exposure ($V_L$) were measured to evaluate the charging stability of the photoconductor, the results are shown in TABLE 3.

Further, each photoconductor and other image forming units were incorporated into one body as a cartridge as shown in FIG. 3. The cartridge thus prepared was set in a laser printer employing reversal development, and 1,000 copies were continuously made. The difference in image density between the image first obtained and the image obtained on the 1,000th sheet. The results are also shown in TABLE 3.

TABLE 3

| | Electrostatic Capacity Change Ratio (%) | $V_D$ (V) after Intermission After 1 min. | After 10 min. | After 30 min. | $V_L$ (V) afterIntermission After 1 min. | After 10 min. | After 30 min. | Difference in Image Density |
|---|---|---|---|---|---|---|---|---|
| Ex. 1 | 27 | 790 | 800 | 850 | 90 | 100 | 150 | slight |
| Ex. 2 | 25 | 790 | 820 | 850 | 90 | 120 | 150 | slight |
| Ex. 3 | 20 | 800 | 830 | 850 | 100 | 130 | 150 | slight |
| Ex. 4 | 20 | 800 | 830 | 850 | 100 | 130 | 150 | slight |
| Ex. 5 | 20 | 800 | 830 | 850 | 100 | 130 | 150 | slight |
| Ex. 6 | 15 | 830 | 830 | 850 | 120 | 120 | 150 | none |
| Ex. 7 | 10 | 850 | 850 | 850 | 150 | 150 | 150 | none |
| Ex. 8 | 25 | 800 | 830 | 840 | 100 | 120 | 140 | none |
| Ex. 9 | 25 | 800 | 820 | 840 | 100 | 120 | 140 | none |
| Comp. Ex. 1 | 35 | 780 | 790 | 820 | 80 | 90 | 120 | large |
| Comp. Ex. 2 | 40 | 760 | 780 | 820 | 60 | 80 | 120 | large |
| Comp. Ex. 3 | 55 | 750 | 780 | 820 | 50 | 80 | 120 | large |

To evaluate the durability of the photoconductor, each photoconductor and other image forming units were incorporated into one body as the cartridge as shown in FIG. 3, and the cartridge thus prepared was set in a laser printer employing reversal development, and 10,000 copies were continuously made. The obtained image after making of 10,000 copies was evaluated.

Further, after making of 100,000 copies, the image quality was evaluated, and peeling of the top layer was checked. Using the photoconductors obtained in Examples 1, 8 and 9, the abrasion wear of the charge transport layer was measured in terms of the decrease in thickness thereof after making of 100,000 copies. The results can shown in TABLE 4.

TABLE 4

| | Image Quality after Making of 10,000 Copies | After Making of 100,000 Copies Image Quality | Peeling of Top Layer | Abrasion Wear of CTL |
|---|---|---|---|---|
| Ex. 1 | non-printed white line in half-tone area after making of 5000 copies | Acceptable for practical use | Partially observed. | 3 $\mu$m |
| Ex. 2 | non-printed white line in half-tone area after making of 5000 copies | Acceptable for practical use | Not observed. | — |
| Ex. 3 | non-printed white line in half-tone area after making of 10000 copies | Acceptable for practical use | Not observed. | — |
| Ex. 4 | no abnormal image | Acceptable for practical use | Not observed. | — |
| Ex. 5 | no abnormal image | Acceptable for practical use | Not observed. | — |
| Ex. 6 | non-printed white line in half-tone area after making of 5000 copies | Slight toner deposition on background | Not observed. | — |
| Ex. 7 | non-printed | Acceptable | Not | — |

TABLE 4-continued

| | Image Quality after Making of 10,000 Copies | After Making of 100,000 Copies | | |
|---|---|---|---|---|
| | | Image Quality | Peeling of Top Layer | Abrasion Wear of CTL |
| | white line in half-tone area after making of 5000 copies | for practical use | observed. | |
| Ex. 8 | non-printed white line in half-tone area after making of 5000 copies | Acceptable for practical use | Not observed. | 0.5 μm |
| Ex. 9 | non-printed white line in half-tone area after making of 5000 copies | Acceptable for practical use | Not observed. | 1 μm |
| Comp. Ex. 1 | toner deposition on background after making of 1000 copies | Toner deposition on background | Partially observed. | — |
| Comp. Ex. 2 | toner deposition on background after making of 1000 copies | Toner deposition on background | Not observed. | — |
| Comp. Ex. 3 | toner deposition on background after making of 1000 copies | Toner deposition on background | Partially observed. | — |

Japanese Patent Application No. 11-053548 filed Mar. 2, 1999, Japanese Patent Application No. 11-053549 filed Mar. 2, 1999, and Japanese Patent Application No. 11-053550 filed Mar. 2, 1999 are hereby incorporated by reference.

What is claimed is:

1. An electrophotographic image forming process comprising the steps of charging, light exposure, reversal development, and image transfer, using an electrophotographic photoconductor comprising an electroconductive support and a photoconductive layer formed thereon, with a residual solvent being contained in said photoconductor at a concentration of 10 to 10,000 ppm, and said electrophotographic photoconductor showing a residual potential change ratio of 200% or less.

2. The electrophotographic image forming process as claimed in claim 1, wherein said image transfer step is carried out using a charger which is disposed in contact with said photoconductor.

3. The electrophotographic image forming process as claimed in claim 2, wherein said charger is in the form of a belt.

4. An electrophotographic image forming process comprising the steps of charging, light exposure, reversal development, and image transfer, using an electrophotographic photoconductor comprising an electroconductive support and a photoconductive layer formed thereon, with a residual solvent being contained in said photoconductor at a concentration of 10 to 10,000 ppm, and said electrophotographic photoconductor showing a sensitivity change ratio of 30% or less.

5. The electrophotographic image forming process as claimed in claim 4, wherein said image transfer step is carried out using a charger which is disposed in contact with said photoconductor.

6. The electrophotographic image forming process as claimed in claim 5, wherein said charger is in the form of a belt.

7. An electrophotographic image forming process comprising the steps of charging, light exposure, reversal development, and image transfer, using an electrophotographic photoconductor comprising an electroconductive support and a photoconductive layer formed thereon, with a residual solvent being contained in said photoconductor at a concentration of 10 to 10,000 ppm, and said electrophotographic photoconductor showing an electrostatic capacity change ratio of 30% or less.

8. The electrophotographic image forming process as claimed in claim 7, wherein said image transfer step is carried out using a charger which is disposed in contact with said photoconductor.

9. The electrophotographic image forming process as claimed in claim 8, wherein said charger is in the form of a belt.

10. An electrophotographic image forming process comprising the steps of charging, light exposure, reversal development, and image transfer, using an electrophotographic photoconductor comprising an electroconductive support and a photoconductive layer formed thereon, with a residual solvent being contained in said photoconductor at a concentration of 10 to 10,000 ppm, and said electrophotographic photoconductor showing a residual potential change ratio of 200% or less, a sensitivity change ratio of 30% or less, and an electrostatic capacity change ratio of 30% or less.

11. The electrophotographic image forming process as claimed in claim 10, wherein said image transfer step is carried out using a charger which is disposed in contact with said photoconductor.

12. The electrophotographic image forming process as claimed in claim 11, wherein said charger is in the form of a belt.

13. An electrophotographic photoconductor comprising an electroconductive support, and a photoconductive layer formed thereon, with a residual solvent being contained in said photoconductor at a concentration of 10 to 10,000 ppm, for use with an electrophotographic image forming process comprising the steps of charging, light exposure, reversal development, and image transfer, said electrophotographic photoconductor showing a residual potential change ratio of 200% or less.

14. The photoconductor as claimed in claim 13, wherein said image transfer step is carried out using a charger which is disposed in contact with said photoconductor.

15. The photoconductor as claimed in claim 14, wherein said charger is in the form of a belt.

16. The photoconductor as claimed in claim 13, wherein said solvent comprises a halogen-free solvent.

17. The photoconductor as claimed in claim 13, wherein said solvent is contained in said photoconductor at a concentration of 100 to 1,000 ppm.

18. The photoconductor as claimed in claim 13, further comprising an undercoat layer which is provided between said electroconductive support and said photoconductive layer.

19. The photoconductor as claimed in claim 13, further comprising a protective layer which is provided on said photoconductive layer.

20. The photoconductor as claimed in claim 19, wherein said protective layer comprises a filler.

21. The photoconductor as claimed in claim 20, wherein said filler comprises an electroconductive powder.

22. The photoconductor as claimed in claim 20, wherein said filler comprises a fluorine-containing resin powder.

23. The photoconductor as claimed in claim 13, wherein said photoconductive layer comprises a phthalocyanine pigment.

24. The photoconductor as claimed in claim 23, wherein said phthalocyanine pigment comprises a titanyl phthalocyanine pigment exhibiting at least one diffraction peak at 27.2±0.2° in terms of a Bragg angle of 2θ in an X-ray diffraction spectrum using a Cu-Kα ray with a wavelength of 1.54 Å.

25. An electrophotographic photoconductor comprising an electroconductive support, and a photoconductive layer formed thereon, with a residual solvent being contained in said photoconductor at a concentration of 10 to 10,000 ppm, for use with an electrophotographic image forming process comprising the steps of charging, light exposure, reversal development, and image transfer, said electrophotographic photoconductor showing a sensitivity change ratio of 30% or less.

26. The photoconductor as claimed in claim 25, wherein said image transfer step is carried out using a charger which is disposed in contact with said photoconductor.

27. The photoconductor as claimed in claim 25, wherein said charger is in the form of a belt.

28. The photoconductor as claimed in claim 25, wherein said solvent comprises a halogen-free solvent.

29. The photoconductor as claimed in claim 25, wherein said solvent is contained in said photoconductor at a concentration of 100 to 1,000 ppm.

30. The photoconductor as claimed in claim 25, further comprising an undercoat layer which is provided between said electroconductive support and said photoconductive layer.

31. The photoconductor as claimed in claim 25, further comprising a protective layer which is provided on said photoconductive layer.

32. The photoconductor as claimed in claim 31, wherein said protective layer comprises a filler.

33. The photoconductor as claimed in claim 32, wherein said filler comprises an electroconductive powder.

34. The photoconductor as claimed in claim 32, wherein said filler comprises a fluorine-containing resin powder.

35. The photoconductor as claimed in claim 25, wherein said photoconductive layer comprises a phthalocyanine pigment.

36. The photoconductor as claimed in claim 35, wherein said phthalocyanine pigment comprises a titanyl phthalocyanine pigment exhibiting at least one diffraction peak at 27.2±0.2° in terms of Bragg angle of 2θ in an X-ray diffraction spectrum using a Cu-Kα ray with a wavelength of 1.54 Å.

37. An electrophotographic photoconductor comprising an electroconductive support, and a photoconductive layer formed thereon, with a residual solvent being contained in said photoconductor at a concentration of 10 to 10,000 ppm, for use with an electrophotographic image forming process comprising the steps of charging, light exposure, reversal development, and image transfer, said electrophotographic photoconductor showing an electrostatic capacity change ratio of 30% or less.

38. The photoconductor as claimed in claim 37, wherein said image transfer step is carried out using a charger which is disposed in contact with said photoconductor.

39. The photoconductor as claimed in claim 38, wherein said charger is in the form of a belt.

40. The photoconductor as claimed in claim 37, wherein said solvent comprises a halogen-free solvent.

41. The photoconductor as claimed in claim 37, wherein said solvent is contained in said photoconductor at a concentration of 100 to 1,000 ppm.

42. The photoconductor as claimed in claim 37, further comprising an under coal layer which is provided between said electroconductive support and said photoconductive layer.

43. The photoconductor as claimed in claim 37, further comprising a protective layer which is provided on said photoconductive layer.

44. The photoconductor as claimed in claim 43, wherein said protective layer comprises a filler.

45. The photoconductor as claimed in claim 44, wherein said filler comprises an electroconductive powder.

46. The photoconductor as claimed in claim 44, wherein said filler comprises a fluorine-containing resin powder.

47. The photoconductor as claimed in claim 37, wherein said photoconductive layer comprises a phthalocyanine pigment.

48. The photoconductor as claimed in claim 47, wherein said phthalocyanine pigment comprises a titanyl phthalocyanine pigment exhibiting at least one diffraction peak at 27.2±0.2° in terms of a Bragg angle of 2θ in an X-ray diffraction spectrum using a Cu-Kα ray with a wavelength of 1.54 Å.

49. An electrophotographic photoconductor comprising an electroconductive support, and a photoconductive layer formed thereon, with a residual solvent being contained in said photoconductor at a concentration of 10 to 10,000 ppm, for use with an electrophotographic image forming process comprising the steps of charging, light exposure, reversal development, and image transfer, said electrophotographic photoconductor showing a residual potential change ratio of 200% or less, a sensitivity change ratio of 30% or less, and an electrostatic capacity change ratio of 30% or less.

50. The photoconductor as claimed in claim 49, wherein said image transfer step is carried out using a charger which is disposed in contact with said photoconductor.

51. The photoconductor as claimed in claim 50, wherein said charger is in the form of a belt.

52. The photoconductor as claimed in claim 49, wherein said solvent comprises a halogen-free solvent.

53. The photoconductor as claimed in claim 49, wherein said solvent is contained in said photoconductor at a concentration of 100 to 1,000 ppm.

54. The photoconductor as claimed in claim 49, further comprising an undercoat layer which is provided between said electroconductive support and said photoconductive layer.

55. The photoconductor as claimed in claim 49, further comprising a protective layer which is provided on said photoconductive layer.

56. The photoconductor as claimed in claim 55, wherein said protective layer comprises a filler.

57. The photoconductor as claimed in claim 56, wherein said filler comprises an electroconductive powder.

58. The photoconductor as claimed in claim 56, wherein said filler comprises a fluorine-containing resin powder.

59. The photoconductor as claimed in claim 49, wherein said photoconductive layer comprises a phthalocyanine pigment.

60. The photoconductor as claimed in claim 59, wherein said phthalocyanine pigment comprises a titanyl phthalocyanine pigment exhibiting at least one diffraction peak at 27.2±0.2° in terms of a Bragg angle of 2θ in an X-ray diffraction spectrum using a Cu-Kα ray with a wavelength of 1.54 Å.

* * * * *